United States Patent [19]

Howlett

[11] Patent Number: 4,519,319

[45] Date of Patent: May 28, 1985

[54] TUBULAR PAPERBOARD DISPLAY STAND

[75] Inventor: Robert J. Howlett, Edison, N.J.

[73] Assignee: Container Corporation of America, Chicago, Ill.

[21] Appl. No.: 380,078

[22] Filed: May 20, 1982

[51] Int. Cl.[3] ..... A47B 47/06

[52] U.S. Cl. ..... 108/111; 206/45; 248/174; 312/259

[58] Field of Search ..... 312/257 R, 258, 259; 297/442; 108/111; 248/174; 206/44 R, 45, 45.31

[56] References Cited

U.S. PATENT DOCUMENTS

| | | | |
|---|---|---|---|
| 969,831 | 9/1910 | Alsop | 248/174 |
| 1,301,797 | 4/1919 | Ziegler | 248/174 |
| 1,614,701 | 1/1927 | Webster | 206/45 |
| 1,896,721 | 2/1933 | Richards | 248/174 |
| 1,947,168 | 2/1934 | Potter | 248/174 |
| 1,959,619 | 5/1934 | Ebert | 248/174 |
| 2,041,751 | 5/1936 | Folsom et al. | 248/174 |
| 2,043,791 | 6/1936 | Barron | 248/174 |
| 2,080,105 | 5/1937 | Bacon | 248/174 |
| 2,324,232 | 7/1943 | Pantalone | 248/174 X |
| 2,708,085 | 5/1955 | Bonaccorsi | 248/174 |
| 2,801,145 | 7/1957 | Jones | 312/159 |
| 2,805,909 | 9/1957 | Derman | 312/259 |
| 2,940,710 | 6/1960 | Adams | 248/174 |
| 3,313,585 | 4/1967 | Berger et al. | 312/259 |
| 3,331,634 | 7/1967 | Harrison, Jr. | 297/442 |
| 3,365,258 | 1/1968 | Downing | 312/258 X |
| 3,420,362 | 1/1969 | Kleingers, Jr. | 248/174 |

FOREIGN PATENT DOCUMENTS

| | | | |
|---|---|---|---|
| 1269509 | 4/1972 | United Kingdom | 206/44 R |

*Primary Examiner*—Francis K. Zugel
*Assistant Examiner*—Thomas A. Rendos
*Attorney, Agent, or Firm*—Richard W. Carpenter

[57] ABSTRACT

A collapsible paperboard display stand including a base section formed from a pre-glued tubular structure that is collapsible and which may be readily assembled by pushing upper portions of the front, side, and end walls against corresponding portions of the rear side and end walls of the structure.

1 Claim, 13 Drawing Figures

TUBULAR PAPERBOARD DISPLAY STAND

BACKGROUND OF THE INVENTION

1. Field of the Invention

This invention relates generally to a display stand, and more particularly to a paperboard display stand having a base of tubular construction which is formed from one-piece blank of foldable sheet material such as paperboard.

SUMMARY OF THE INVENTION

It is the object of the invention to provide a paperboard display stand having a tubular base which may be formed on conventional box-making equipment and which is completely collapsible and can be quickly erected.

A more specific object of the invention is the provision of a paperboard display stand having a tubular base with upper and lower portions separated from each other, whereby certain sections of the upper portion can be folded in face-to-face with other sections of the upper portion to provide a reinforced area capable of supporting one or more shelves.

These and other objects of the invention will be apparent from an examination of the following description and drawings:

It will be understood that, for purposes of clarity, certain elements may have been intentionally omitted from certain views where they are believed to be illustrated to better advantage in other views.

DESCRIPTION OF THE PREFERRED EMBODIMENT

Figure 1:
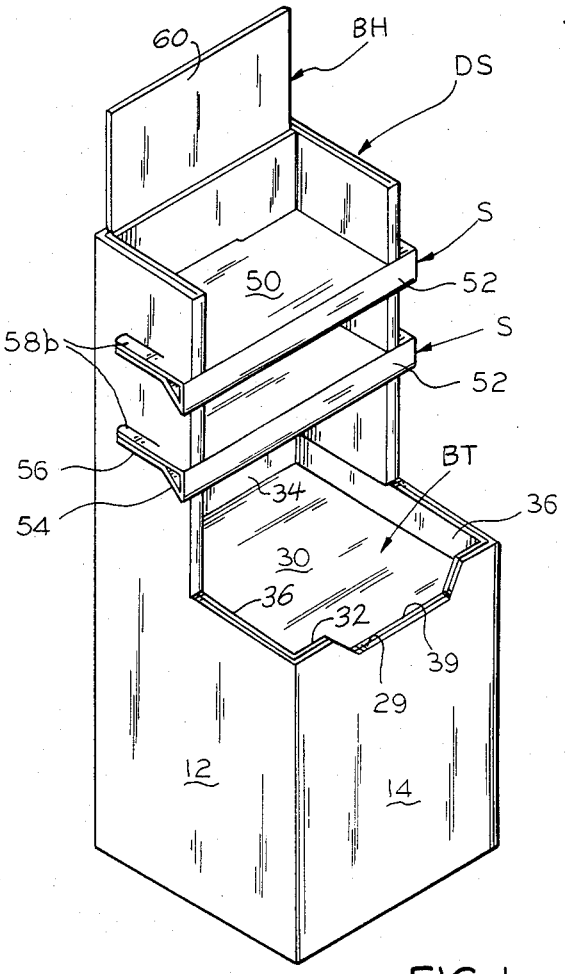
FIG. 1 is a fragmentary perspective view of a display stand embodying features of the invention.
Figure 2:
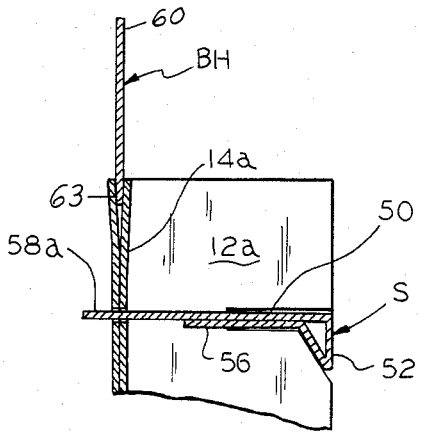
FIG. 2 is a fragmentary vertical sectional view of a portion of the structure illustrated in FIG. 1.

Referring now to the drawings for a better understanding of the invention, and particularly to FIG. 1, it will be seen that the novel display stand DS embodying features of the invention includes a generally tubular base member, indicated generally at B, together with a tray T, a tray support TS, one or more shelves S, and an advertising header or display panel H.

Figure 4:
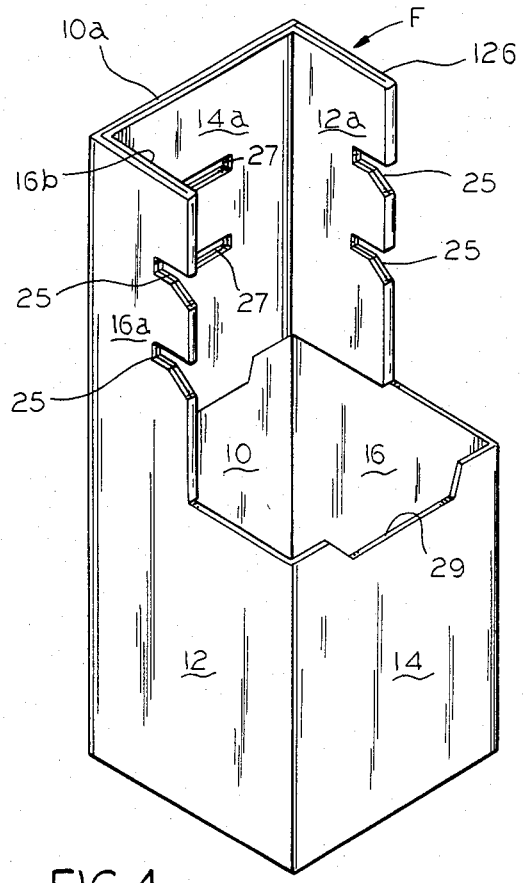
FIGS. 3 and 4 are perspective views similar to that of FIG. 1, but illustrate the manner in which the base portion of the display stand is assembled.
Figure 3:
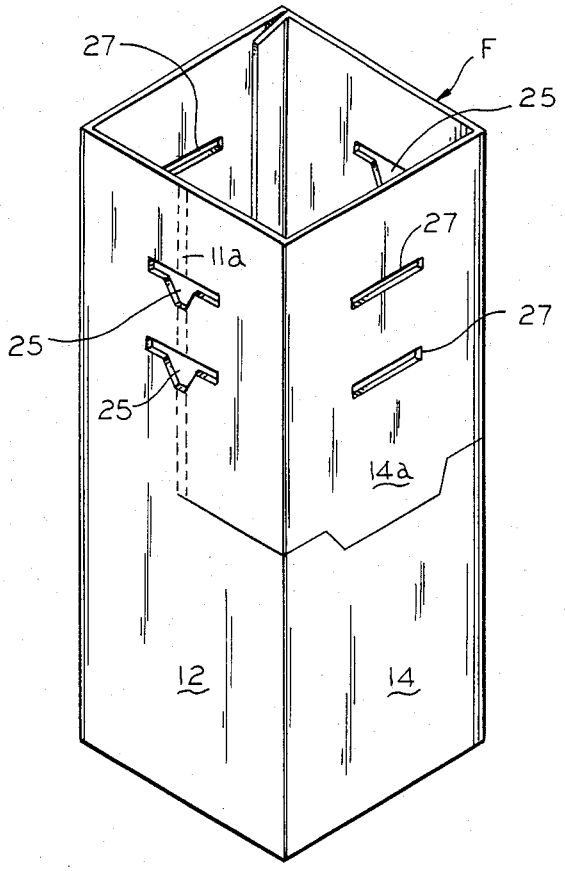

The primary novelty of the invention resides essentially in the design and construction of the base B which, as best seen in FIGS. 3 and 4, is formed from a conventional tubular structure which may be assembled on ordinary box-making equipment and which is collapsible and can be readily assembled.

Figure 9:
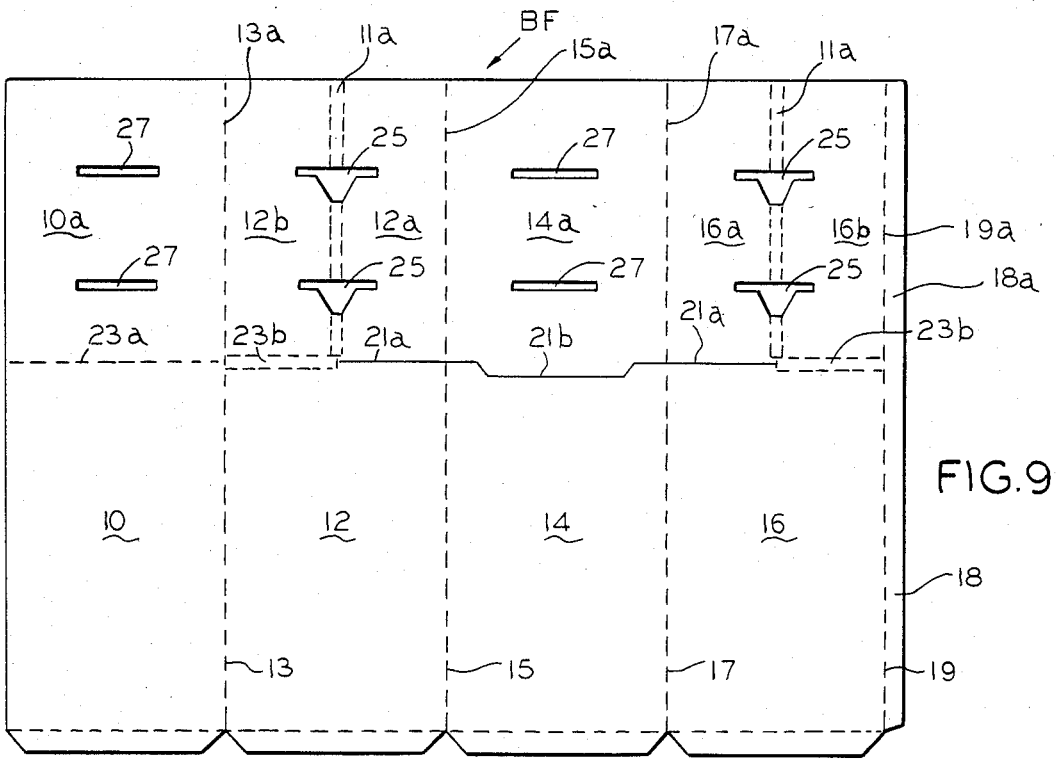
FIGS. 9, 10, 11, 12 and 13 are plan views of blanks of foldable sheet material from which the structures illustrated in FIGS. 4, 5, 6, 7, and 8, respectively, may be formed.

Base B may be formed from a unitary blank BF of foldable paperboard illustrated in FIG. 9.

Referring to FIG. 9 it will be seen that blank BF includes from left to right a rear side wall panel 10, a first end wall panel 12, a front side wall panel 14, a second end wall panel 16, and a connecting flap 18, all of which are foldably jointed to each other along parallel fold lines 13, 15, 17, and 19, respectively.

By securing the connecting flap 18 to rear side wall panel 10 in any desired manner, such as by gluing or stapling, a tubular structure is formed, as best seen in FIG. 3. Still referring to FIG. 9, it will be seen that front side wall panel 14 and the front portions of end wall panels 12 and 16 are divided into upper and lower areas by means of cut lines **21*b* and 21*a*, respectively. The remaining portions of end wall panel 12 and 16 and rear side wall panel 10 may be divided into upper and lower portions by fold lines 23*b* and 23*a***, respectively in order to fold the blank or glued tube in half for convenience of shipping or storing.

It will be seen that the upper portions of panels 10, 12, 14, and 16 and connecting flap 18 have been designated as **10*a*, 12*b* and 12*a*, 14*a*, 16*a* and 16*b* and 18*a*, respectively, and are foldably joined to each other on fold lines 13*a*, 15*a*, 17*a*, and 19*a*, respectively. Also the upper portions of panels 12 and 16 are divided by fold lines 11*a* into panels 12*a* and 12*b* and 16*a* and 16*b***, respectively.

As best seen in FIG. 4, cut lines **21*a* and 21*b* permit the upper portion 14*a* of front side wall panel 14 and the front sections 12*a* and 16*a* of the upper portions of end wall panels 12 and 16 to be pushed rearwardly so as to lie against the inner faces of upper portions of rear side wall panel 10 and rear sections 12*b* and 16*b* of upper portions of end wall panels 12 and 16**, respectively.

Thus, the upper portion of the tubular base is double ply, so that it is strong and capable of supporting shelves as described later in the specification.

It will be seen that the upper portions of end wall panels 12 and 16 are provided with openings 25 for receiving end portions of shelves in a manner hereinafter described. Also the upper portions of front and rear side wall panels 10 and 14 are provided with slots 27 which also receive portions of shelves as described hereinafter.

Figure 5:
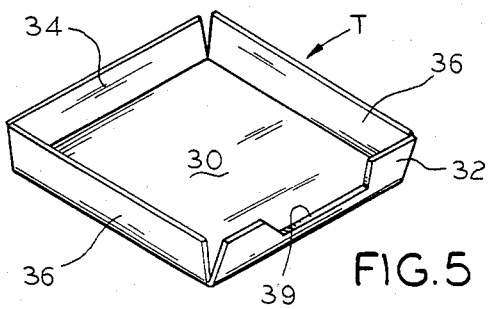
FIG. 5 is a perspective view of the tray of the display stand.
Figure 10:
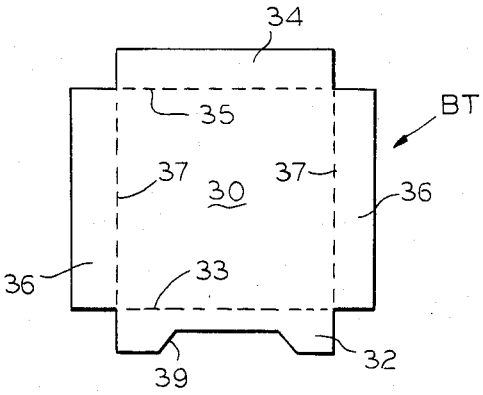

Referring now to FIGS. 5 and 10 of the drawings. it will be seen that the tray indicated generally at T in FIG. 5 may be formed from a unitary blank BT of foldable paperboard illustrated in FIG. 10.

Tray T includes a central panel 30 having a pair of opposed front and rear flanges 32 and 34 foldably joined to the front and rear edges thereof on fold lines 33 and 35, respectively, and disposed to extend upwardly therefrom. Tray T also includes a pair of opposed end flanges 36 which are foldably joined to opposite end edges of panel 30 on fold lines 37. End flanges 36 are also disposed to extend upwardly from panel 30 to provide a tray structure which can be inserted within base B, as shown in FIG. 1.

Figure 6:
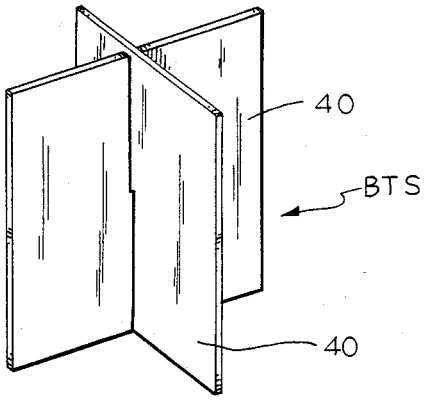
FIG. 6 is a perspective view of the tray supporting structure for the display stand.
Figure 11:
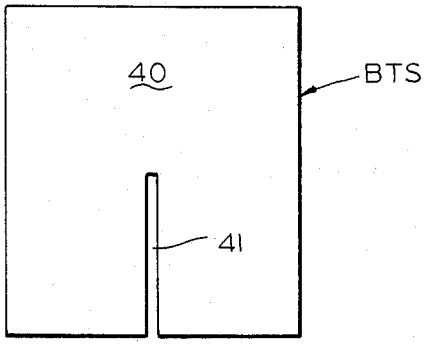

In order to support the tray T and maintain it in proper position, there may be provided a tray support structure, indicated generally at TS and illustrated in FIG. 6, which may be formed from a pair of blanks BTS of the type illustrated in FIG. 11.

It will be seen that each of the blanks BTS include a main panel 40 having a slot 41 adapted to mate with a related portion of another panel to provide a cross-shaped structure, as shown in FIG. 6, for supporting the tray.

Figure 7:
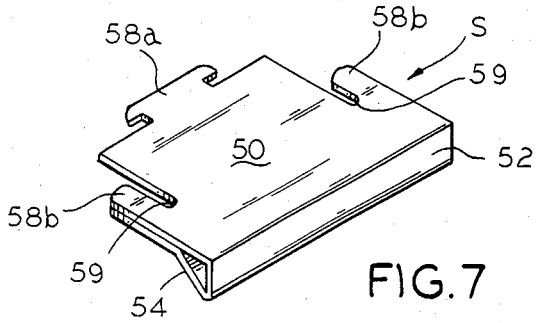
FIG. 7 is a perspective view of one of the shelves of the display stand.
Figure 12:
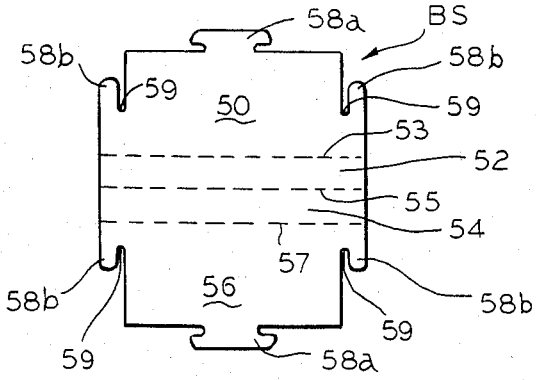

As previously mentioned, the base may be provided with one or more pairs of opposed slots 25 adapted to receive one or more shelves S, of the type illustrated in FIG. 7, which may each be formed from the unitary blank BS illustrated in FIG. 12. Each of the shelves S includes an upper panel 50 a front panel 52 a sloping rear panel 54 and a lower panel 56 which are foldably joined to each other on fold lines 53, 55, and 57, respectively. Each of the upper and lower panels 50 and 56 may be provided with an integral, rearwardly projecting, generally T-shaped lock tab 58*a* adapted to be received within complimentary slots 27 of front and rear side wall panel upper sections 10*a* and 14*a*.

Still referring to FIGS. 7 and 11 it will be seen that each of the shelves also includes side projections or extensions 58*b* which define, with the central portions of the shelves, slots 59 adapted to mate with slots 25 in the portion of the base, as best seen in FIG. 1, to provide a means of attaching and maintaining the shelves in position on the base. The triangular structural arrangement afforded by the front and rear narrow panels 52 and 54 of each shelf serves to provide added strength and rigidity for each shelf.

Figure 8:
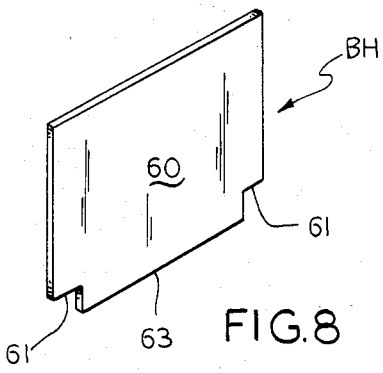
FIG. 8 is a perspective view of the header of the display stand.
Figure 13:
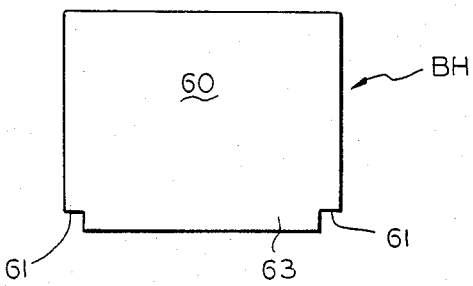

In order to have a place for a display or advertising material there may be provided a header indicated generally at H and illustrated in FIG. 8, which may be formed from blank BH of paperboard illustrated in FIG. 13. Header H includes a main panel 60 having corners recessed at 61 to provide a central downwardly projecting portion or extension 63 adapted to be received between the upper portions of the front and rear side wall panels, as best shown in FIG. 1.

Thus, it will be seen that the novel display stand DS includes many features and particularly the unique base structure, as previously described, which may be formed from a one-piece blank of foldable paperboard and may be pre-glued on conventional equipment, so that it can be readily erected and assembled.

What is claimed is:

1. A collapsible display stand including a base formed of a unitary blank of foldable sheet material, such as paperboard, and comprising:

(a) pairs of opposed front and rear side wall and end wall panels foldably joined to each other to form a tubular structure;

(b) said front side wall panel and said end wall panels each having upper and lower portions separated from each other by transversely extending cut lines;

(c) said end wall panel upper portions each being divided, by a vertically disposed fold line, into front and rear sections which include aligned slots for receiving a horizontally disposed shelf;

(d) said front side wall panel upper portion and said end wall panel upper portion front sections being disposed to lie in face-to-face relation with inner surfaces of an upper portion of said rear side wall panel and rear sections of upper portions of said end wall panels, respectively, to reinforce upper areas of the rear and side wall panels of said structure for support of said shelf;

(e) said shelf including upper and lower panels disposed in face-to-face relation and having corresponding front edges foldably interconnected by a pair of relatively narrow connecting flanges which form with said upper and lower panels a triangular structure.

* * * * *